United States Patent [19]

Steuer

[11] Patent Number: 4,869,441

[45] Date of Patent: Sep. 26, 1989

[54] SUBORDINATE-AMMUNITION MISSILE WITH EXTENDABLE GLIDE WINGS

[75] Inventor: Raimar Steuer, Leinburg, Fed. Rep. of Germany

[73] Assignee: Diehl GmbH & Co., Nuremberg, Fed. Rep. of Germany

[21] Appl. No.: 231,667

[22] Filed: Aug. 11, 1988

Related U.S. Application Data

[63] Continuation of Ser. No. 831,465, Feb. 19, 1986, abandoned.

[30] Foreign Application Priority Data

Jul. 3, 1985 [DE] Fed. Rep. of Germany ..... 3523769

[51] Int. Cl.[4] ..... F42B 13/32; F42B 13/50

[52] U.S. Cl. ..... 244/3.28; 102/393; 244/49

[58] Field of Search ..... 244/3.28, 3.29, 46, 244/49; 102/393, 489

[56] References Cited

U.S. PATENT DOCUMENTS

| | | | |
|---|---|---|---|
| 3,507,150 | 4/1970 | Stengel | 244/49 |
| 3,647,163 | 3/1972 | Sweeney | 244/49 |
| 4,364,531 | 12/1982 | Knoski | 244/49 |
| 4,440,360 | 4/1984 | Hallström | 244/3.28 |
| 4,455,943 | 6/1984 | Pinson | 102/393 |
| 4,522,356 | 6/1985 | Lair et al. | 244/3.28 |
| 4,558,645 | 12/1985 | Boeder et al. | 102/393 |
| 4,635,881 | 1/1987 | Brieseck et al. | 244/3.27 |

FOREIGN PATENT DOCUMENTS

| | | | |
|---|---|---|---|
| 2805496 | 8/1978 | Fed. Rep. of Germany | 244/3.28 |
| 650322 | 2/1951 | United Kingdom | 244/49 |
| 1597098 | 9/1981 | United Kingdom | 244/3.28 |
| 2149481 | 6/1985 | United Kingdom | 244/3.28 |

OTHER PUBLICATIONS

"Defense Electronics", Jun. 1984, p. 102.

"Aviation Week & Space Technology", Mar. 2, 1981, p. 51.

*Primary Examiner*—Deborah L. Kyle

*Assistant Examiner*—Michael J. Carone

*Attorney, Agent, or Firm*—Scully, Scott Murphy & Presser

[57] ABSTRACT

A flying body for subordinate-ammunition missile with extendable glide wings. The flying body or missile of the above-mentioned type has the wings pivotally retained in attachments which are arranged generally in parallel with the longitudinal axis of the missile on the casing of the fuselage of the missile, and which are equipped with longitudinal grooves each respectively stowing a retracted wing.

2 Claims, 1 Drawing Sheet

II
I
I
1
2
3
4
5
6
7
8
9
10
11
12
13
14
15
16
17
18
19
20
21
22
23
24
4, 19

SUBORDINATE-AMMUNITION MISSILE WITH EXTENDABLE GLIDE WINGS

This application is a continuation of 093,101 filed Sept. 1, 1987, which is a continuation of 831,465 filed Feb. 19, 1986, now abandoned.

BACKGROUND OF THE INVENTION

1. Field of the Invention

The present invention relates to a flying body or subordinate-ammunition missile with extendable glide wings.

2. Discussion of the Prior Art

A missile or flying body of this type is currently known from the disclosure of the published magazine "Defense-Electronics", Volume June 1984, picture caption on page 102, as a subordinate-ammunition projectile which is controllable during its final flight phase, and which is ejected from a carrier rocket approaching a target area in ballistic flight at supersonic speed. Through the implementation of a preprogrammed actuation, the individual subordinate-ammunition missiles are steered into an extended glide path which is generally in parallel with the surface of the earth, so as to acquire an armored target which is to be attacked through the intermediary of a timed fuse-scanning head.

In the interest of obtaining high degree of aerodynamic performance; in essence, especially with respect to a stable and lengthy tracking or searching gliding flight, a subordinate-ammunition missile of this type, in addition to control surfaces for maneuvering during the final target homing phase, is also equipped with stabilizing wings or fins which, essentially, need to only possess lift surface properties; and need not in any particularity be repositioned or otherwise displaced for purposes of maneuvering, with respect to the longitudinal axis of the flying body or missile. However, because of reasons of limitations in space, these wings must be retracted against the body or fuselage of the subordinate-ammunition missile during their positioning in the carrier; in which any stowage of the wings within the periphery of the missile body or fuselage is not possible, inasmuch as the interior space of the fuselage is already optimally utilized by the electronic aggregates and by the warhead.

Stabilizing or glide wings which are retracted against the casing surface of the fuselage on the outside of the fuselage during positioning in the carrier, possess only a low level of aerodynamic performance, inasmuch as their width is limited by a curved segment of the fuselage cross-section; thus, upon the swinging out from their longitudinal or axial orientation (after expulsion of the subordinate-ammunition from its carrier), cannot offer the desired wing surface for enhanced gliding flight properties. Moreover, such types of wings, which are rotatable about a point on the casing surface of the body or fuselage, can only be articulated or hinged at an aerodynamically unfavorable location on the fuselage, because of technological reasons relating to the ammunition and control aggregates within the fuselage, which in any case will also fail to enhance the gliding flight characteristics.

SUMMARY OF THE INVENTION

Accordingly, it is an object of the present invention that, in recognition of these conditions which are encountered in the technology, a flying body or missile of the above-mentioned type be equipped with extendable wings which will provide more favorable flying characteristics.

The foregoing object is inventively attained in that the flying body or missile of the above-mentioned type has the wings pivotally retained in attachments which are arranged generally in parallel with the longitudinal axis of the missile on the casing of the fuselage of the missile, and which are equipped with longitudinal grooves each respectively stowing a retracted wing.

The foregoing object is predicated on the recognition that the in cross-section peripheral packing of the subordinate-ammunition missile within the carrier casing, possesses in the longitudinal section-transverse plane of every subordinate-ammunition missile, an otherwise unused space extending in parallel with its fuselage. Into this unused space there can extend on the fuselage of the subordinate-ammunition, the attachments, diametrically oppositely located, the so-called fairings, each of which is adapted to receive an extendable swing-wing which, in the outwardly extended position thereof, possesses a large aerodynamically-effective wing surface.

The curvature of this surface, in a one-dimensional covering in the form of a flexible casing, is in its cross-sectional geometry extensively determined by the cross-section of a profiled front spar, which is articulated to one of the respective wing attachments, and which in the position wherein it is retracted against the fuselage, is received pr stowed in a mechanically stable manner within a groove which extends externally of the subordinate-ammunition fuselage; in essence, stowed within the attachments. As a result thereof, no entry into the fuselage itself is required, and thereby no restrictive influence exerted over the usable space for the subordinate-ammunition. The attachments can be offset or arranged almost at will along the longitudinal direction of the body or fuselage of the subordinate-ammunition in order to thereby ensure an expedient locating of the aerodynamically-effective point of attachment for the extended wing relative to the location of the center of gravity of the flying body or missile; in effect, to be able to optimize the flight characteristics. Herein, it is only necessary to ensure that the rear edges of the extended wing and their mountings maintain a sufficient distance along the fuselage with respect to the leading edge of the control surface at the trailing end region of the fuselage, so that here there will be afforded appropriate oncoming airflow conditions.

BRIEF DESCRIPTION OF THE DRAWINGS

Additional alternatives and modifications, as ell as further features and advantages of the invention, may now be readily ascertained from the following detailed description of a preferred embodiment of the invention, taken in conjunction with the accompanying substantially diagrammatic drawings; in which.

DETAILED DESCRIPTION

Figures 1, 2:
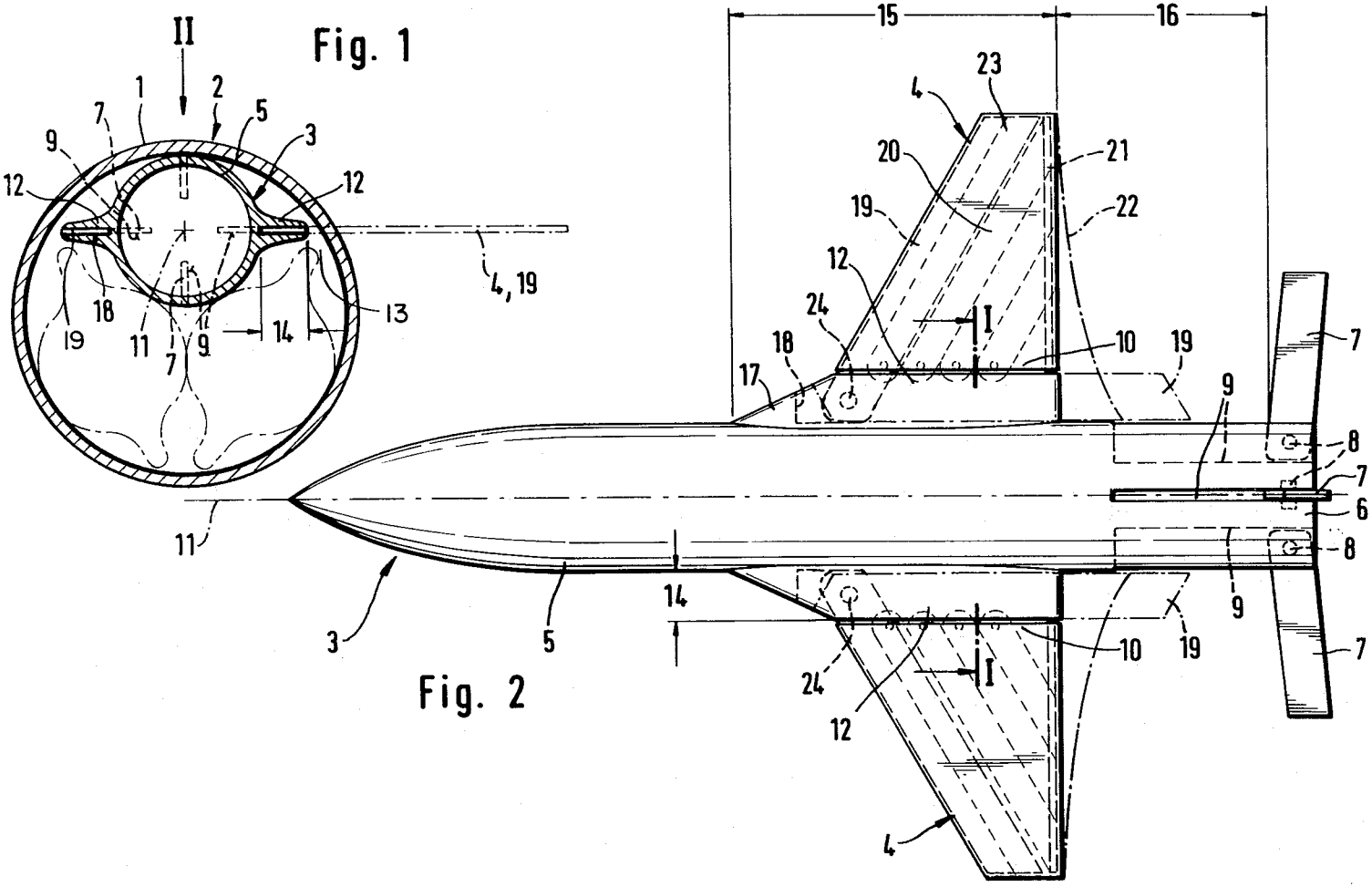
FIG. 1 illustrates a fragmentary cross-sectional view of the arrangement of one of a plurality of subordinate-ammunition missiles within a carrier casing.
FIG. 2 illustrates a plan view of a missile according to FIG. 1, shown with extended wings and control surfaces.

Within the casing 1 of a subordinate-ammunition carrier 2, preferably an artillery rocket, arranged in a longitudinal sectional plane are a plurality of subordinate-ammunition missiles 3, which adjoin each other peripherally along the inner jacketing wall surface of the casing 1, which are radially ejected over a target area for attacking either detected or expected armored targets therein, after the rupturing of the casing 1. Through the intermediary of a built-in, preprogrammed control arrangement, the individual subordinate-ammunition missiles 3 are steered into a glide path which extends generally in parallel with the surface of the ground, in order to periodically scan the target area for a target object which is to be attacked, by means of a timed fuse-scanning head transverse to the direction of flight along a strip extending in parallel with the direction of flight, which target object is then attacked by leaving the glide flight path, as is described in greater detail in U.S. Pat. No. 4,606,514, assigned to jointly the assignee of this application and to Martin-Marietta Corporation, Bethesda, Md., at the steepest possible target approach angle.

In the interest of obtaining the highest possible gliding flight performance, and a more satisfactory maneuverability through its control surface 7, the missile 3 is equipped with extendable glide wings 4. In order to save space, during their positioning in the carrier 2, the wings are retracted against the body or fuselage 5 of the missile 3, and only subsequent to the ejection from the carrier 2 in which they are positioned, are they extended into the operative position as illustrated in FIG. 2. Serving for the maneuvering (flight path control) are the control surfaces 7 which are pivotally articulated in the trailing end region 6, which are outwardly extendable about pivot axes 8 from grooves 9 provided in the structure of the fuselage 5 when the carrier 2 has ejected its subordinate-ammunition missiles 3.

However, the necessary space for the stowage of any retractable wings 4 is not available in the projectile fuselage 5 ahead of the tail end region 6, wherein the wings present a substantially larger surface expanse than those of the control surfaces 7, and whose root area 10 extends considerably beyond that portion of the fuselage 5 which is taken up by the timed fuse-signal processing and auxiliary control apparatus, as well as, especially, also by the armor-destroying active charge of the subordinate-ammunition.

As a consequence, for the retention and the retracted stowage of the wings 4, there are provided two attachments 12, located diametrically opposite each other along a generatrix of the casing surface of the fuselage 5, and thereby somewhat in parallel with its longitudinal axis 11, such attachments 12 being also designated as so-called fairings. Relative to the arrangement of the subordinate-ammunition missiles 3 in their carrier 2 (referring to FIG. 1), these attachments 12 are located in a plane in which, on both sides of the missile fuselage 5, there is afforded an open space 13 facing towards the applicable neighboring inner shell jacketing wall surface of the carrier casing 1 (which is readily geometrically obtained through the circumscribing of a small circle by a substantially larger circle). At a suitable proportioning of the diameter of the missile 3 relative to the carrier 2, the radial width 14 can be almost one-half of the diameter of the fuselage of the missile 5. The axially parallel-length 15 is correlated, pursuant to aerodynamic conditions, with respect to the geometry of the missile fuselage 5 and in accordance with the geometry of the extended wings 4, which are fastened to the fuselage 5 at or closely behind the rearward end of the attachments 12. For a sufficiently undisrupted onflow of air against the control surfaces 7 along the fuselage 5 of the missile, the attachments 12 must leave an adequate clear distance 16; however, for the remainder, they can be selectively located along the length of the fuselage 5 of the missile in the most aerodynamically expedient position (in which the aerodynamically-effective point of attachment for the wing lies axially at least slightly behind the center of gravity of the missile 3). Similarly, due to technological aerodynamic reasons, the front end surface 17 of the attachments 12 extends at an incline into the external contour of the fuselage 5 of the missile.

Accordingly, the attachments 12 serve for the pivotable mounting of swing-wings 4, which in their folded position are retracted into grooves 18; however, which do not extend from the attachments 12 into the interior of the fuselage 5.

Preferably, in the swing-wings 4 this pertains to an aerodynamically-profiled front spar 19, about which there is conducted a flexible covering 20; for example, constructed from sail cloth which, at an outwardly pivoted front spar 19, is rearwardly tensioned by a rear spar 21 or cord 22; as is described in greater detail in U.S. patent application No. 772,247, assigned to the assignee of this application for a similar cloth swing-wing. For the spreading apart of the rear spar 21 which is hinged to the free end 23 of the front spar 19, pursuant to the disclosure of U.S. patent application No. 772,247 there can be provided, in the root area 10, a toggle joint; a swivel rod (not shown) which is hinged in the region of the pivot axis 24 of the front spar; when the covering 20 is not stretched through a tensioning cord 22. The width of the front spar 19, in the interest of obtaining the most extensive profiling which is a prerequisite for the curvature of the covering 20, is selected to be as large as possible, and thereby approximately as large as the radial width 14 of the attachments 12 which, in their grooves 18, besides the front spar 19, also stow the possibly present rear spar 21 (and when required, also the folded-in covering 20) of the respective wings 4.

Similarly, in the interest of obtaining the largest possible operative surface for the wing 4, the length of the front spar 19, which is aerodynamically profiled in cross-section, is not restricted to the axial length 15 of the attachments 12. During the stowage of the subordinate-ammunition missile 3 in its carrier it is not disturbing when the front spar 19, which when folded against the fuselage 5 (as is illustrated in phantom lines in FIG. 2) projects rearwardly from the attachments 12 and extends into the area of the tail end control surfaces 7, when upon this wing 4 being outwardly extended, there is provided an adequate clear distance 16 along the fuselage 5.

The swing-wing 4, however, can also be constructed in accordance with U.S. Pat. No. 4,635,881, May 9, 1984; assigned to the assignee of this application; in essence, possess the configuration of flat box-like, lamellar plate structures which are telescopingly displaceable within each other, and upon the outward pivoting of the front spar 19 about its pivoting axis 24, are extended apart relative to each other so as to together form the aerodynamically-shaped wing surface from the cross-sectional shapes of the successive lamellar structures.

What is claimed is:

1. In an airborne body having a fuselage; axially-parallel fairings on the fuselage of said airborne body; elongate grooves being formed in said fairings; and outwardly pivotable glide wings each having a front spar of generally the height of the fairings; the improvement comprising: each said fairing having a radial height of approximately one-half the diameter of the fuselage of said airborne body; each said wing being retracted into a respective fairing by said front spar which is aerodynamically profiled and articulated in the forward region of said fairings, said wings each having a large-surfaced, arched configuration for the trailing edge in the extended position thereof; and a distance between the rear ends of said fairings on the extended wings and tail end control surfaces on the fuselage of said airborne body which is exposed to an oncoming airflow, said front spar, in the retracted position thereof within the fairing, extending into said distance beyond the rearward end of the fairing.

2. Airborne body as claimed in claim 1, wherein said fuselage of the airborne body angles into the forward end surface of said fairings, said fairings being positioned in an optimized position along said fuselage with respect to contacting a point of connection of the wing to said fairing relative to the center of gravity of the airborne body.

* * * * *